US011275320B1

(12) United States Patent
Imamiya

(10) Patent No.: US 11,275,320 B1
(45) Date of Patent: Mar. 15, 2022

(54) IMAGE FORMING APPARATUS AND CHARGING METHOD

(71) Applicant: TOSHIBA TEC KABUSHIKI KAISHA, Tokyo (JP)

(72) Inventor: Koji Imamiya, Kawasaki Kanagawa (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/110,547

(22) Filed: Dec. 3, 2020

(51) Int. Cl.
*G03G 15/02* (2006.01)
*G03G 15/00* (2006.01)

(52) U.S. Cl.
CPC ..... *G03G 15/0266* (2013.01); *G03G 15/0216* (2013.01); *G03G 15/5037* (2013.01)

(58) Field of Classification Search
CPC ..... G03G 15/0266; G03G 15/5037
See application file for complete search history.

(56) References Cited

U.S. PATENT DOCUMENTS 5,583,616 A * 12/1996 Yamamoto ..... G03G 15/0266 399/51
2013/0148991 A1 6/2013 Sakata
2013/0195475 A1 8/2013 Kubo
2019/0384203 A1* 12/2019 Komai ..... G03G 15/80
2020/0026214 A1* 1/2020 Kidaka ..... G03G 15/5037

FOREIGN PATENT DOCUMENTS

JP 07-261513 10/1995
JP 2017-068171 4/2017

* cited by examiner

*Primary Examiner* — Arlene Heredia
(74) *Attorney, Agent, or Firm* — Amin, Turocy & Watson LLP

(57) ABSTRACT

According to one embodiment, an image forming apparatus includes a photoreceptor, a charging member, an application unit, and a control unit. An image is formed on the photoreceptor. The charging member is in contact with or close to a surface of the photoreceptor. The application unit applies a voltage to the charging member. The control unit performs control so that a current flowing through the charging member and the photoreceptor becomes a constant current when the photoreceptor is in an unused state, measures a voltage when the constant current flows and stores the measured voltage as a reference voltage, and controls the application unit to apply a voltage obtained by adding correction according to a value indicating a usage amount of the photoreceptor to the reference voltage.

20 Claims, 8 Drawing Sheets

IMAGE FORMING APPARATUS AND CHARGING METHOD

FIELD

Embodiments described herein relate generally to an image forming apparatus and a charging method.

BACKGROUND

In an image forming apparatus using an electrophotographic method, as a method for charging a photoreceptor as an image carrier, there is a contact charging method in which the photoreceptor is charged by applying a voltage to a charging member in contact with the photoreceptor. In the above-described image forming apparatus, a surface potential of the photoreceptor becomes small in an absolute value due to reduction of a film on a surface layer of the photoreceptor, which may cause occurrence of a defect such as image fogging.

DETAILED DESCRIPTION

In general, according to one embodiment, an image forming apparatus includes a photoreceptor, a charging member, an application unit, and a control unit. An image is formed on the photoreceptor. The charging member is in contact with or close to a surface of the photoreceptor. The application unit applies a voltage to the charging member. The control unit performs control so that a current flowing through the charging member and the photoreceptor becomes a constant current when the photoreceptor is in an unused state, measures a voltage when the constant current flows and stores the measured voltage as a reference voltage, and controls the application unit to apply a voltage obtained by adding correction according to a value indicating a usage amount of the photoreceptor to the reference voltage.

Hereinafter, the image forming apparatus according to the embodiment will be described with reference to the drawings. In each drawing used for description of the following embodiments, a scale of each unit may be appropriately changed. In each drawing used for the description of the following embodiments, a configuration may be omitted for the description. In each drawing and the application, the same reference sign represents a similar element.

Figure 1:
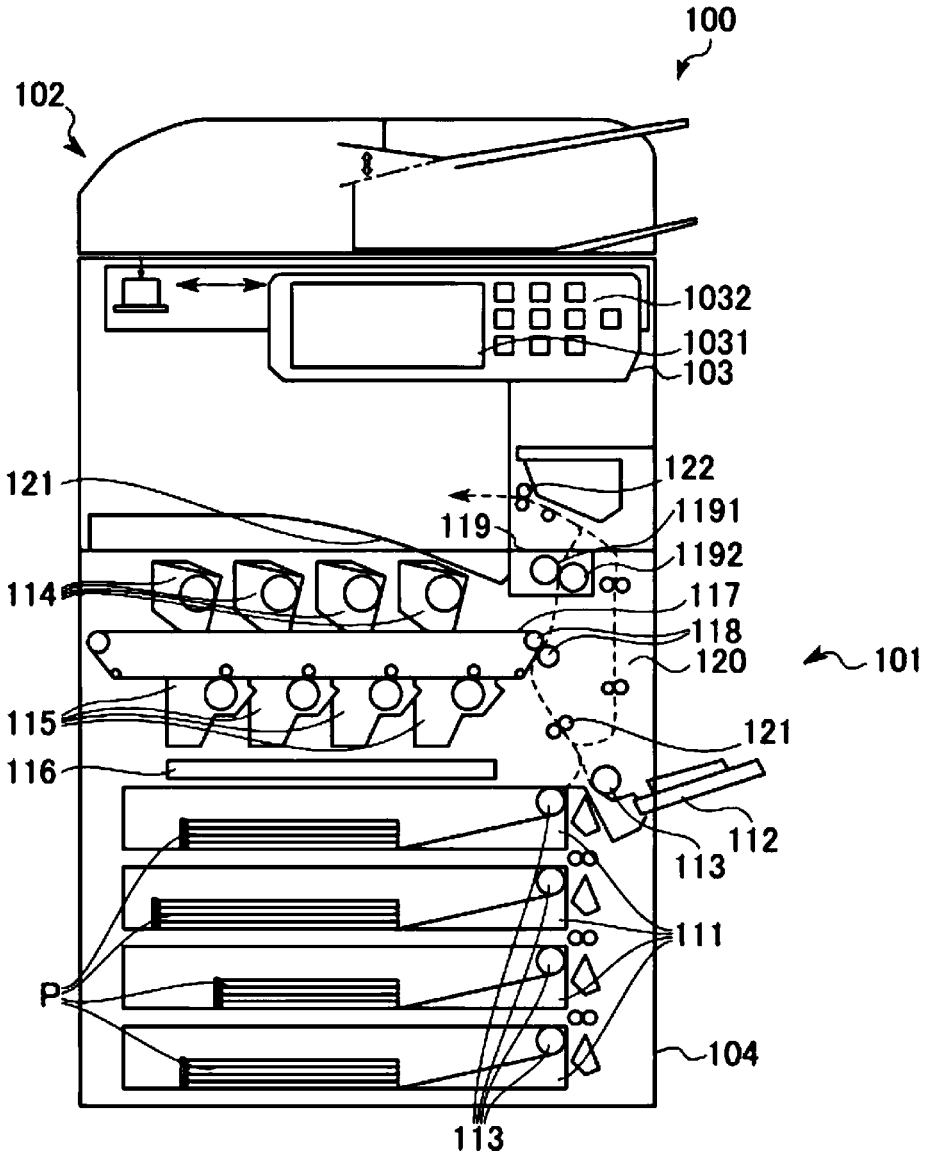
FIG. 1 is a diagram illustrating an example of a configuration of a main unit of an image forming apparatus according to an embodiment.

FIG. 1 is a diagram illustrating an example of a configuration of a main unit of an image forming apparatus 100 according to the embodiment.

The image forming apparatus 100 is, for example, a multifunction peripheral (MFP), a copier, a printer, or a facsimile. However, hereinafter, the image forming apparatus 100 will be described as the MFP. The image forming apparatus 100 includes, for example, a printing function, a scanning function, a copying function, and a facsimile function. The printing function is a function of forming an image on an image forming medium P by using a recording material such as toner. The image forming medium P is, for example, sheet-shaped paper. The scanning function is a function of reading an image from an original document on which the image is formed. The copying function is a function of printing the image read from the original document by using the scanning function on the image forming medium P by using the printing function. The image forming apparatus 100 includes a printer 101, a scanner 102, an operation panel 103, and a housing 104 as an example.

The printer 101 prints the image on the image forming medium P by forming the image by using the recording material such as toner or ink. The printer 101 includes, for example, an electrophotographic (laser) printer, an inkjet type printer or another type printer, and performs printing by using the printer. The printer 101 includes, as an example, a paper feeding tray 111, a manual feeding tray 112, a paper feeding roller 113, a toner cartridge 114, an image forming unit 115, an optical scanning apparatus 116, a transfer belt 117, a secondary transfer roller 118, a fixing unit 119, a double-sided unit 120, a conveyance roller 121, and a paper discharging tray 122.

The paper feeding tray 111 is a tray that stores the image forming medium P used for printing.

The manual feeding tray 112 is a tray for manually feeding the image forming medium P.

The paper feeding roller 113 rotates by the action of a motor, thereby carrying out the image forming medium P stored in the paper feeding tray 111 or the manual feeding tray 112 from the paper feeding tray 111 or the manual feeding tray 112.

The toner cartridge 114 stores the recording material such as toner to be supplied to the image forming unit 115. The image forming apparatus 100 includes one or a plurality of toner cartridges 114. As an example, the image forming apparatus 100 includes four toner cartridges 114 as illustrated in FIG. 1. The four toner cartridges 114 respectively store recording materials corresponding to respective colors of cyan, magenta, yellow, and key (black) (CMYK). The colors of the recording materials stored in the toner cartridge 114 are not limited to the respective colors of CMYK, and may be any other colors. The recording material stored in the toner cartridge 114 may be a special recording material. For example, the toner cartridge 114 stores a decolorable recording material that is decolored at a temperature higher than a predetermined temperature and becomes an invisible state.

Each image forming unit 115 forms an image with toner, and transfers the image to the transfer belt 117 (primary transfer).

The image forming apparatus 100 includes one or a plurality of image forming units 115. As an example, the image forming apparatus 100 includes four image forming units 115 as illustrated in FIG. 1. The respective four image forming units 115 form images with the recording materials corresponding to the respective colors of CMYK.

Figure 2:
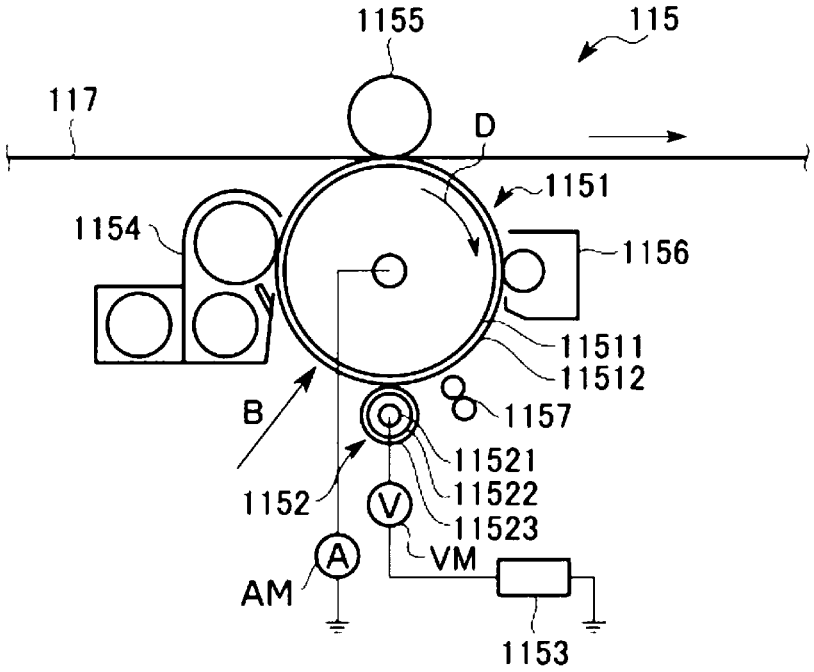
FIG. 2 is a diagram illustrating an image forming unit in FIG. 1.

The image forming unit 115 will be further described with reference to FIG. 2. FIG. 2 is a diagram illustrating the image forming unit 115.

The image forming unit 115 includes, for example, a photoreceptor 1151, a charging roller 1152, a power supply 1153, a developing unit 1154, a primary transfer roller 1155, a cleaner 1156, and a static eliminating lamp 1157.

The photoreceptor 1151 is a columnar or cylindrical roller that rotates in a rotation direction D by the action of a motor. A surface of the photoreceptor 1151 is exposed to a beam B emitted from the optical scanning apparatus 116. Accordingly, an electrostatic latent image is formed on the surface of the photoreceptor 1151. The photoreceptor 1151 includes a base body 11511 and a photoreceptor layer 11512 as an example.

The base body 11511 is a columnar or a cylindrical object made of aluminum.

The photoreceptor layer 11512 is a film-shaped layer formed on a surface of the base body 11511. The photoreceptor layer 11512 is, for example, a dielectric. The photoreceptor layer 11512 is charged by the action of the charging roller 1152. As an example, the photoreceptor layer 11512 has a structure including three layers of an under coat layer (UCL), a charge generation layer (CGL), and a charge transport layer (CTL) in order from a center side.

An amount of electricity Q [C] stored on the surface of the photoreceptor 1151 is proportional to the magnitude of a voltage V [V], and can be represented by $$Q=CV \quad (1).$$

From the above-described formula, capacitance C [F] is inversely proportional to a thickness of the dielectric. Therefore, the capacitance C is inversely proportional to a film thickness of the photoreceptor layer 11512. The film thickness of the photoreceptor layer 11512 becomes thinner due to wear caused by the usage of the photoreceptor 1151. Therefore, the capacitance C increases when the photoreceptor 1151 is used.

The charging roller 1152 is a rotatable columnar or cylindrical roller. The charging roller 1152 is pressed against the photoreceptor 1151 by a spring or a weight. Therefore, the charging roller 1152 rotates following the rotation of the photoreceptor 1151 by a frictional force.

The charging roller 1152 is an example of a charging member.

The charging roller 1152 generates an electric discharge at a portion close to or in contact with the photoreceptor 1151 based upon Paschen's law, thereby charging the surface of the photoreceptor 1151 with a positive charge.

According to JP-A-2009-80045, a discharge limit voltage Vpa [V] in a minute void can be represented by the following equation according to Paschen's law.

$$Vpa[V]=\begin{cases}312+6.2\times10^{6}\cdot G & (G>8[\mu m])\\ 362 & (8[\mu m]\geq G\geq 4.8[\mu m])\\ 75.4\times10^{6}\cdot G & (4.8[\mu m]>G)\end{cases} \quad (2)$$

Here, G [m] is a gap distance between the photoreceptor 1151 and the charging roller 1152. Therefore, as for environmental influences such as temperature, humidity, and atmospheric pressure, when a current value of a DC charging bias is the same, electrification charged on a surface of the photoreceptor layer 11512 is the same, such that a surface potential of the photoreceptor 1151 also becomes the same.

The charging roller 1152 includes, as an example, a support 11521, an elastic body layer 11522, and a surface layer 11523.

The support 11521 is, for example, a shaft made of conductive metal.

The elastic body layer 11522 is formed on an outside of the support 11521. The elastic body layer 11522 is rubber mixed with a conductive material.

The surface layer 11523 is a layer formed on a surface of the elastic body layer 11522. The surface layer 11523 includes, for example, (A) a surface layer standard type, (B) a surface layer fluorine type, and (C) a surface layer carbon conductive type.

(A) The surface layer standard type is obtained by moistening the surface of the elastic body layer 11522 with a urethane-based impregnated liquid.

(B) The surface layer fluorine type is obtained by coating the surface layer of the elastic body layer 11522 with fluorine-based resin.

(C) The surface layer carbon conductive type is obtained by coating the surface layer of the elastic body layer 11522 with a mixture of urethane resin and carbon.

The power supply 1153 is electrically connected to the support 11521 of the charging roller 1152. The power supply 1153 applies a bias to the support 11521, thereby allowing a current to flow through the photoreceptor 1151 and the charging roller 1152. The power supply 1153 is a DC power supply or an AC power supply. When the power supply 1153 is the AC power supply, for example, the power supply 1153 is an AC power supply in which a direct current and an alternating current are superimposed. The power supply 1153 is desirably the DC power supply.

The power supply 1153 is an example of an application unit that applies a voltage to the charging roller 1152.

The image forming unit 115 includes an ammeter AM and a voltmeter VM.

The ammeter AM measures a value of a current I flowing from the charging roller 1152 to the photoreceptor 1151. That is, the ammeter AM measures the value of the current flowing through the charging roller 1152 and the photoreceptor 1151.

The voltmeter VM measures a value (potential difference) of the voltage V at opposite ends of the power supply 1153. That is, the voltmeter VM measures the potential difference between the photoreceptor 1151 and the charging roller 1152.

Figure 4:
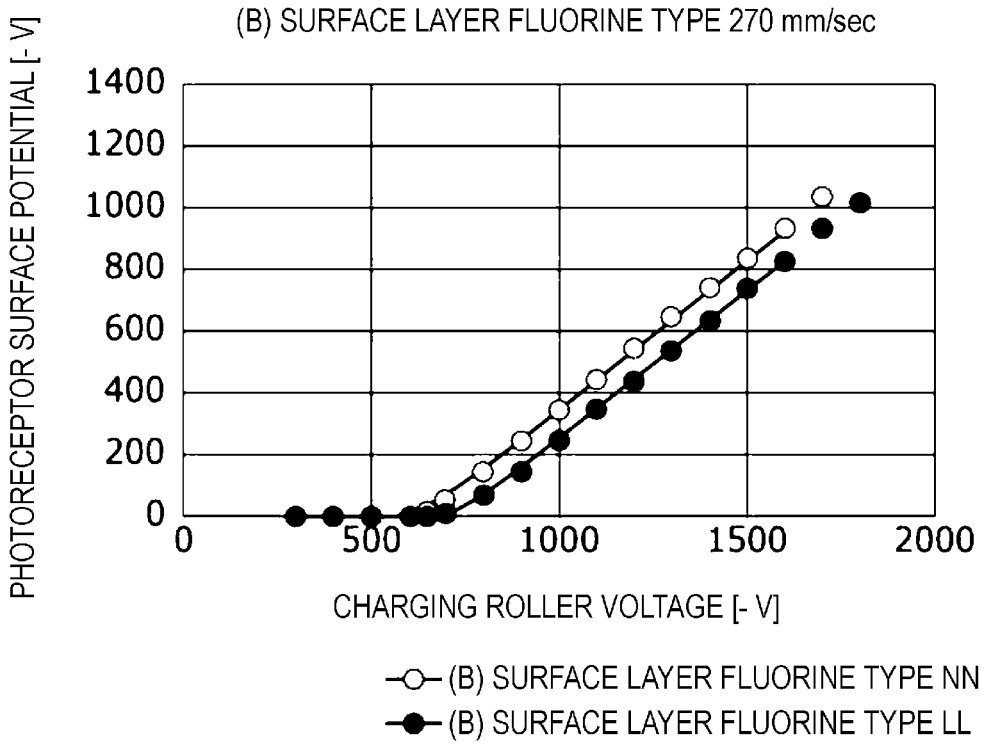
FIG. 4 is a graph illustrating a charging roller voltage-photoreceptor surface potential characteristic.

FIG. 4 illustrates a relationship between the voltage V of the charging roller 1152 and the surface of the photoreceptor 1151. FIG. 4 is a graph illustrating a charging roller voltage-photoreceptor surface potential characteristic.

Figure 5:
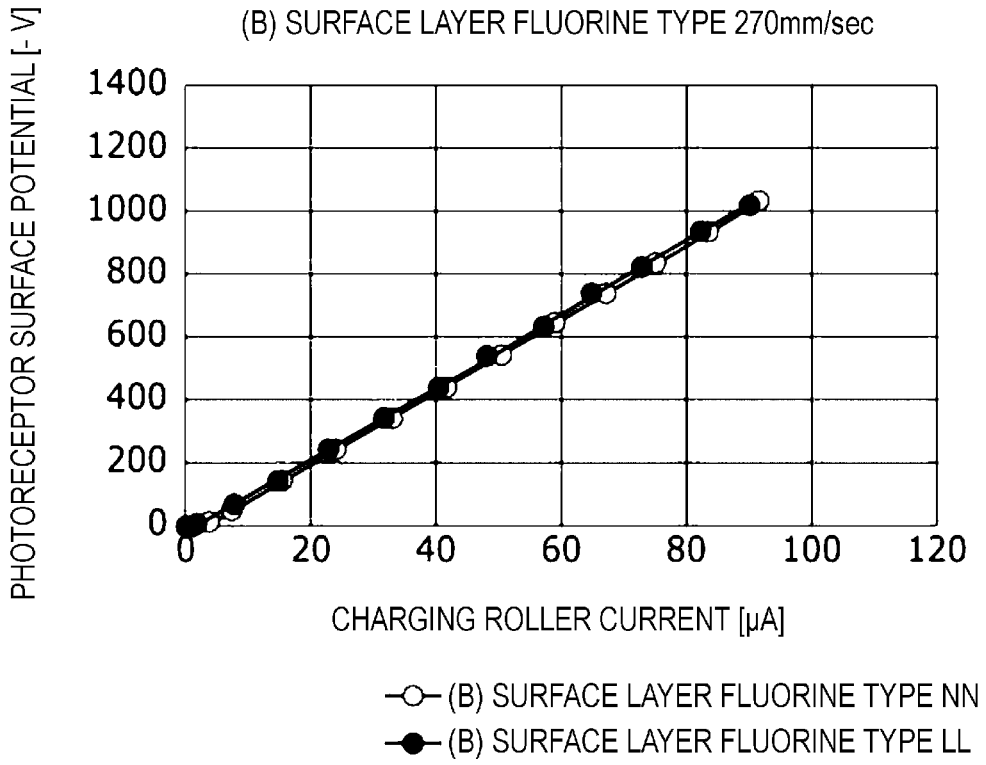
FIG. 5 is a graph illustrating a charging roller current-photoreceptor surface potential characteristic.

FIG. 5 illustrates a relationship between the current I of the charging roller 1152 and the surface of the photoreceptor 1151. FIG. 5 is a graph illustrating a charging roller current-photoreceptor surface potential characteristic.

FIGS. 4 and 5 illustrate values when the charging roller 1152 of (B) the surface layer fluorine type is used. FIGS. 4 and 5 illustrate values for NN and LL in two types of environments. The NN indicates normal temperature and normal humidity. The NN is, for example, the temperature of 23° C. and the humidity of 40% RH to 60% RH. The LL indicates low temperature and low humidity. The LL is, for example, the temperature of 10° C. and the humidity of 10% RH.

As illustrated in FIG. 4, the voltage V of the charging roller 1152 and the surface potential of the photoreceptor are proportional to each other. As illustrated in FIG. 5, the current I of the charging roller 1152 and the surface potential of the photoreceptor are proportional to each other. As illustrated in FIG. 5, the relationship between the current I of the charging roller 1152 and the surface potential of the photoreceptor hardly changes regardless of the temperature and the humidity.

Figure 6:
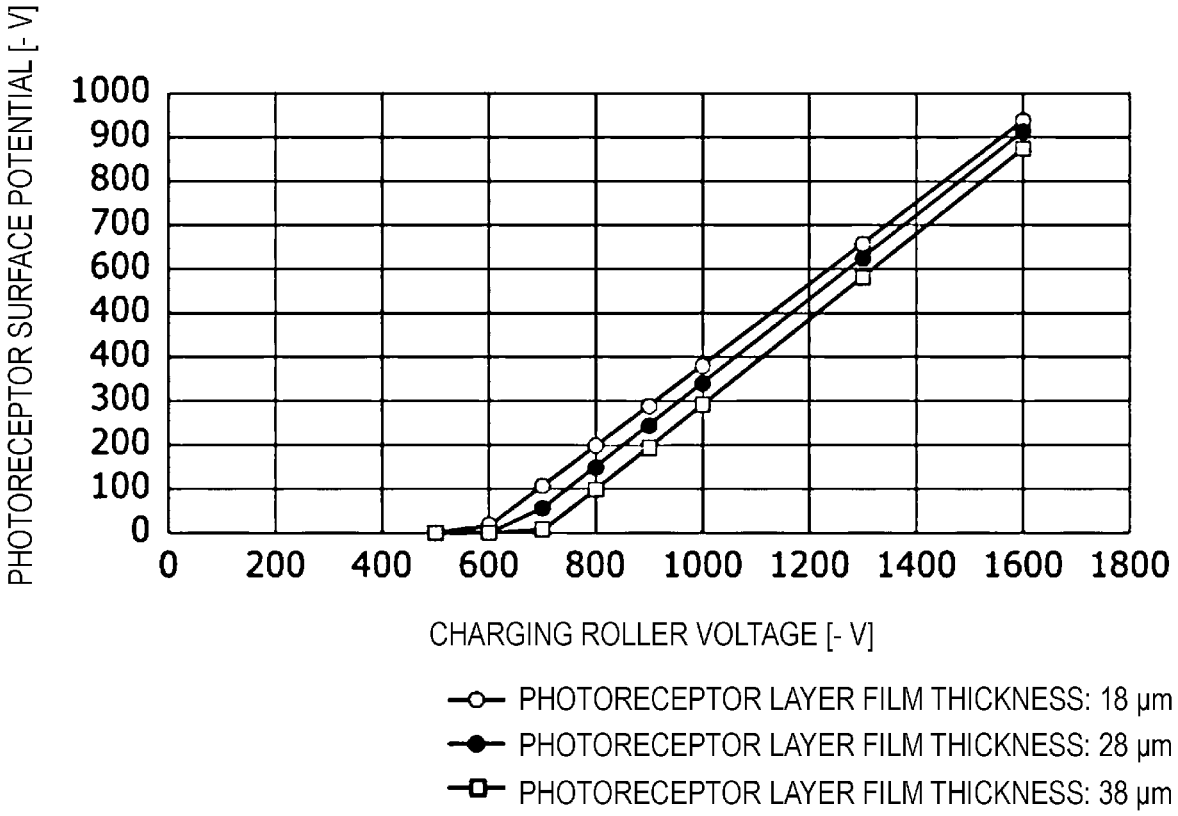
FIG. 6 is a graph illustrating a result of simulating a change in a charging characteristic depending on a film thickness of the photoreceptor.
Figure 7:
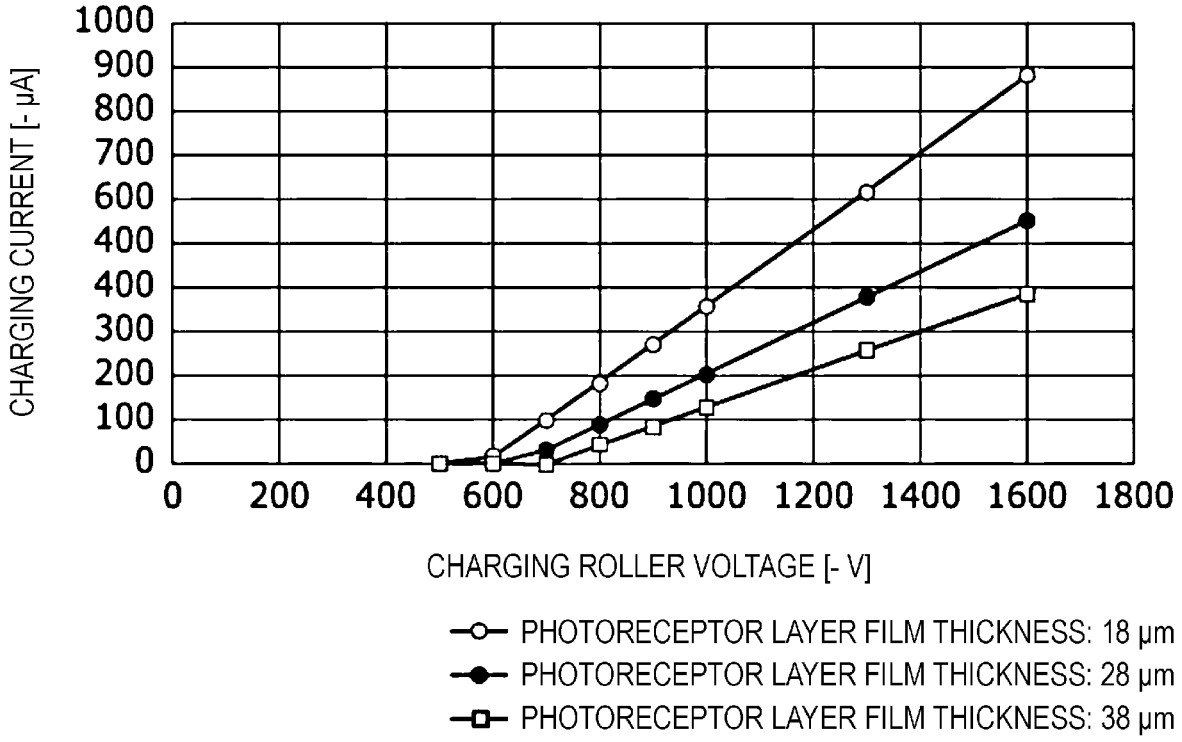
FIG. 7 is a graph illustrating the result of simulating the change.

FIGS. 6 and 7 are graphs illustrating a result of simulating a change in a charging characteristic depending on a film thickness of the photoreceptor 1151. Each condition of the simulation is the temperature of 23° C., the humidity of 50% RH, the atmospheric pressure of 1013 hPa, and the process speed of 270 mm/sec.

As can be seen from FIG. 6, when the film thickness of the photoreceptor layer 11512 is scraped by 10 μm from 28 μm to 18 μm, an absolute value of the surface potential of the photoreceptor increases by about 32 V. Therefore, it can be seen that by correcting the amount, a stable surface potential of the photoreceptor corresponding to the film scraping of the photoreceptor layer 11512 can be obtained. A difference in a charging current illustrated in FIG. 7 is caused by a difference in the capacitance C of the photoreceptor 1151. The capacitance C having the film thickness of 18 μm is 1.6 times the capacitance C having the film thickness of 28 μm, and the capacitance C having the film thickness of 38 μm is 0.7 times the capacitance C having the film thickness of 28 μm.

Figure 8:
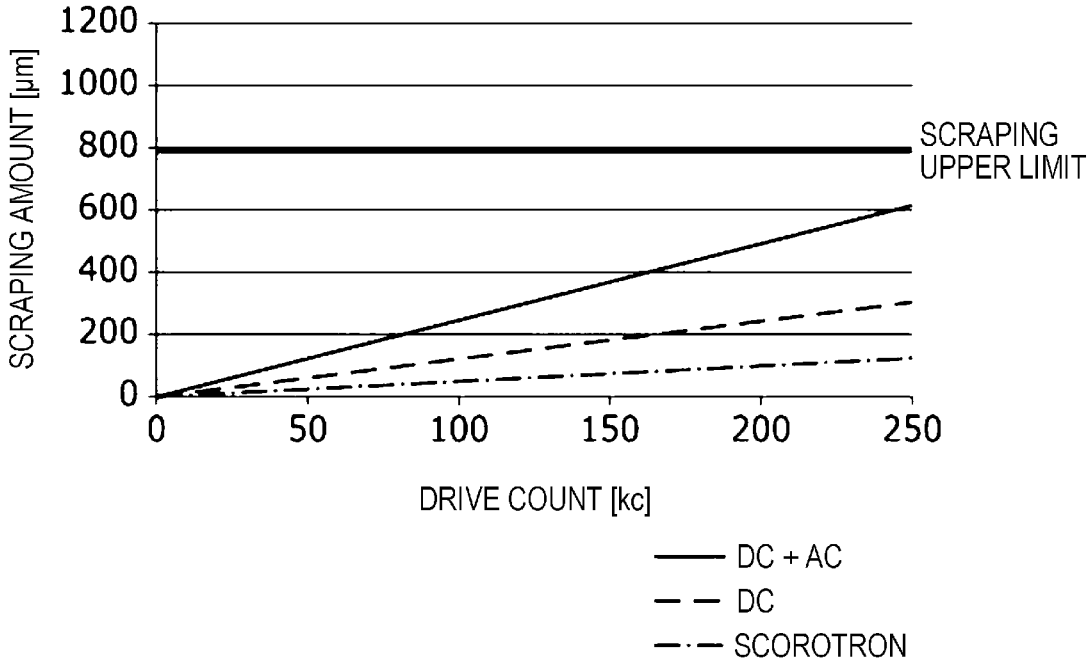
FIG. 8 is a graph illustrating a relationship between a drive time of the photoreceptor and a film scraping amount thereof.

FIG. 8 is a graph illustrating a relationship between a drive time of the photoreceptor 1151 and a film scraping amount thereof. FIG. 8 illustrates a result of a practical life test in the case of three types including a direct current (DC)+an alternating current (AC), DC, and scorotron using the highly durable photoreceptor 1151. The DC+AC indicates a case where an AC bias in which DC and AC are superimposed is applied. The DC indicates a case where a DC bias is applied. The scorotron indicates a case where the photoreceptor 1151 and the charging roller 1152 are not in contact with each other. As illustrated in FIG. 8, it can be seen that the film scraping amount of the scorotron is the smallest, and the film scraping amount is small in the order of the scorotron, the DC, and the DC+AC. As illustrated in FIG. 8, it can be seen that the film scraping amount is proportional to the drive time of the photoreceptor 1151 in each case. A drive count indicates the drive time, and 1 [kc]=2 [sec].

Figure 9:
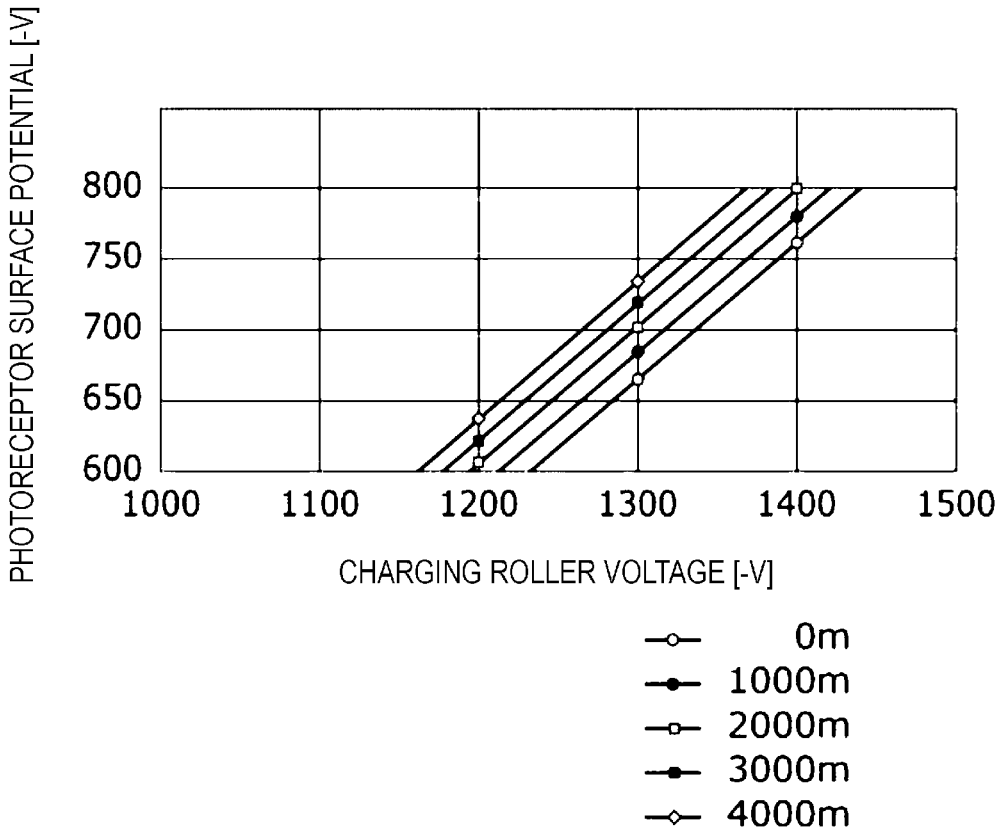
FIG. 9 is a graph illustrating a charging roller voltage-photoreceptor surface potential characteristic for each altitude.

FIG. 9 is a graph illustrating a charging roller voltage-photoreceptor surface potential characteristic for each altitude. As the altitude increases, the atmospheric pressure decreases, and a discharge starting voltage Vpa which stops according to Paschen's law also decreases. Even when the same voltage is applied to the charging roller 1152, as the altitude increases, the absolute value of the surface potential of the photoreceptor becomes large. From FIG. 9, it can be seen that the absolute value of the surface potential of the photoreceptor becomes large by about 20 V as the altitude increases by 1000 m.

The developing unit 1154 develops the electrostatic latent image on the surface of the photoreceptor 1151 by using the recording material supplied from the toner cartridge. Accordingly, the developing unit 1154 forms an image formed by the recording material on the surface of the photoreceptor 1151.

The primary transfer roller 1155 generates a transfer voltage with the photoreceptor 1151. Accordingly, the primary transfer roller 1155 transfers the image formed on the surface of the photoreceptor 1151 to the transfer belt (primary transfer).

The cleaner 1156 removes the recording material remaining on the surface of the photoreceptor 1151. The cleaner 1156 is made of, for example, urethane rubber.

The static eliminating lamp 1157 removes an electric charge remaining on the surface of the photoreceptor 1151.

The optical scanning apparatus 116 is also referred to as a laser scanning unit (LSU). The optical scanning apparatus 116 forms the electrostatic latent image on the surface of the photoreceptor 1151 of each image forming unit 115 by controlling a laser beam according to inputted image data.

The transfer belt 117 is, for example, an endless belt, and can be rotated by the action of a roller (not illustrated). The transfer belt 117 rotates, thereby conveying the image transferred from each image forming unit 115 to a position of the secondary transfer roller 118.

The secondary transfer roller 118 includes two rollers opposite to each other. The secondary transfer roller 118 transfers the image formed on the transfer belt 117 to the image forming medium P passing through between the secondary transfer rollers 118 (secondary transfer).

The fixing unit 119 heats and pressurizes the image forming medium P to which the image is transferred. Accordingly, the image transferred to the image forming medium P is fixed. The fixing unit 119 includes a heating unit 1191 and a pressure roller 1192 which are opposite to each other. The fixing unit 119 includes the heating unit 1191 and the pressure roller 1192 as an example.

The heating unit 1191 is, for example, a roller provided with a heat source for heating the heating unit 1191. The heat source is, for example, a heater. The roller heated by the heat source heats the image forming medium P. Alternatively, the heating unit 1191 may include endless belts suspended on a plurality of rollers.

The pressure roller 1192 presses the image forming medium P passing through between the pressure roller 1192 and the heating unit 1191.

The double-sided unit 120 allows the image forming medium P to be in a state in which printing on a back surface can be performed. For example, the double-sided unit 120 reverses the front and back sides of the image forming medium P by switching back the image forming medium P by using a roller (not illustrated).

The conveyance roller 121 conveys the image forming medium P by rotating by the action of the motor.

The paper discharging tray 122 is a table from which the printed image forming medium P is discharged.

The scanner 102 reads an image from an original document. The scanner 102 is an optical reduction method including an imaging element such as a charge-coupled device (CCD) image sensor. Alternatively, the scanner 102 is a contact image sensor (CIS) method including an imaging element such as a complementary metal-oxide-semiconductor (CMOS) image sensor. Alternatively, the scanner 102 may be another well-known method.

The operation panel 103 includes a man-machine interface for performing input and output between the image forming apparatus 100 and an operator of the image forming apparatus 100. The operation panel 103 includes a touch panel 1031, an input device 1032, and a speaker 1033 as an example.

The touch panel 1031 is formed by stacking a display such as a liquid crystal display or an organic electro-luminescence (EL) display and a pointing device by touch input. The display provided in the touch panel 1031 functions as a display device that displays a screen for notifying the operator of the image forming apparatus 100 of various information. The touch panel 1031 functions as an input device that receives a touch operation by the operator.

The input device 1032 receives an operation by the operator of the image forming apparatus 100. The input device 1032 is, for example, a keypad or a touchpad.

The speaker 1033 outputs an inputted voice signal as a sound wave.

The housing 104 houses each unit of the image forming apparatus 100. The housing 104 fixes each unit of the image forming apparatus 100.

Figure 3:
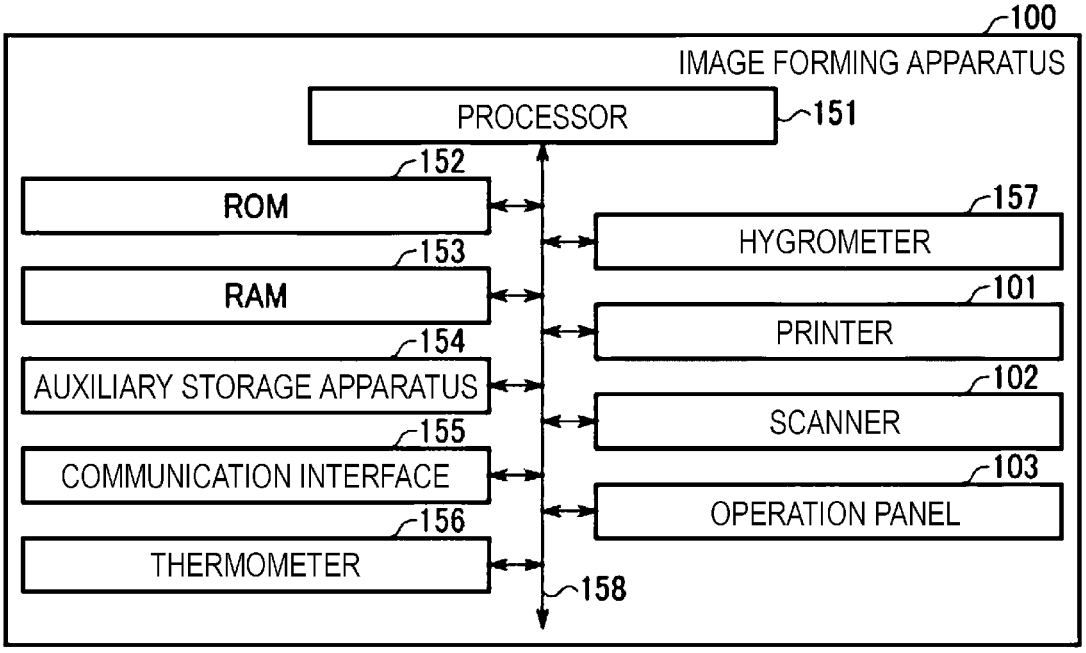
FIG. 3 is a block diagram illustrating a circuit configuration of the main unit.

FIG. 3 is a block diagram illustrating a circuit configuration of the main unit of the image forming apparatus 100. As an example, the image forming apparatus 100 includes a processor 151, a read-only memory (ROM) 152, a random-access memory (RAM) 153, an auxiliary storage apparatus 154, a communication interface 155, a thermometer 156, a hygrometer 157, the printer 101, the scanner 102, and the operation panel 103. A bus 158 connects the above-described respective units.

The processor 151 corresponds to a central part of a computer that performs processing such as calculation and control necessary for the operation of the image forming apparatus 100. The processor 151 controls each unit to realize various functions of the image forming apparatus 100, based upon a program such as firmware, system software, and application software stored in the ROM 152 or the auxiliary storage apparatus 154. The processor 151 executes processing which will be described later based upon the program. A part or all of the programs may be incorporated in a circuit of the processor 151. The processor 151 is, for example, a central processing unit (CPU), a micro processing unit (MPU), a system on a chip (SoC), a digital signal processor (DSP), a graphics processing unit (GPU), an application specific integrated circuit (ASIC), a programmable logic device (PLD) or a field-programmable gate array (FPGA). Alternatively, the processor 151 is a combination of a plurality thereof.

The processor 151 is an example of a control unit.

The ROM 152 corresponds to a main storage apparatus of a computer including the processor 151 as a center. The ROM 152 is a non-volatile memory exclusively used for reading data. The ROM 152 stores, for example, firmware among the above-described programs. The ROM 152 also stores data used by the processor 151 for performing various kinds of processing.

The RAM 153 corresponds to the main storage apparatus of the computer including the processor 151 as the center. The RAM 153 is a memory used for reading and writing data. The RAM 153 is used as a work area for storing data temporarily used by the processor 151 for performing various kinds of processing. The RAM 153 is typically a volatile memory.

The auxiliary storage apparatus 154 corresponds to an auxiliary storage apparatus of the computer including the processor 151 as the center. The auxiliary storage apparatus 154 is, for example, an electric erasable programmable read-only memory (EEPROM), a hard disk drive (HDD) or a flash memory. The auxiliary storage apparatus 154 stores, for example, the system software and the application software among the above-described programs. The auxiliary storage apparatus 154 stores data used by the processor 151 for performing various kinds of processing, data generated by the processing of the processor 151, and various set values. The image forming apparatus 100 may include, as the auxiliary storage apparatus 154, an interface into which a removable storage medium such as a memory card or a universal serial bus (USB) memory can be inserted. The interface writes and reads information to and from the storage medium.

The communication interface 155 is an interface for allowing the image forming apparatus 100 to communicate with another apparatus via the Internet or a network such as a local area network (LAN).

The thermometer 156 measures, for example, the temperature of air in the housing 104.

The hygrometer 157 measures, for example, the humidity of air in the housing 104.

The bus 158 includes a control bus, an address bus, and a data bus, and transmits a signal transmitted and received by each unit of the image forming apparatus 100.

Figure 10:
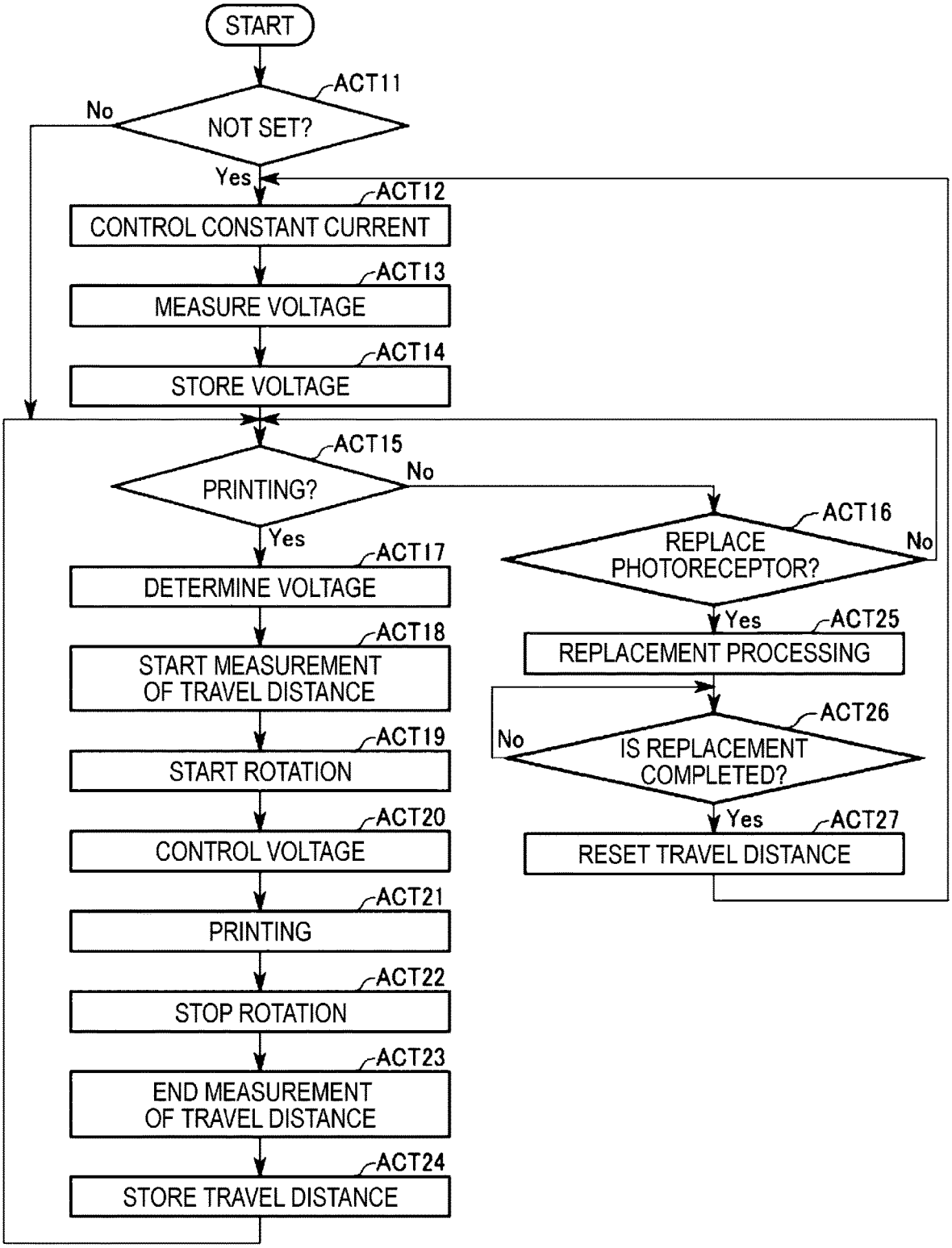
FIG. 10 is a flowchart illustrating an example of processing by a processor in FIG. 3.

Hereinafter, an operation of the image forming apparatus 100 according to the embodiment will be described with reference to FIG. 10. A content of processing in the following operation description is an example, and various processing capable of obtaining the same result can be appropriately used. FIG. 10 is a flowchart illustrating an example of processing by the processor 151 of the image forming apparatus 100. For example, the processor 151 executes the processing of FIG. 10 based upon the program stored in the ROM 152 or the auxiliary storage apparatus 154.

For example, the processor 151 starts the processing illustrated in FIG. 10 when the image forming apparatus 100 starts.

In ACT 11, the processor 151 determines whether a reference voltage is not set. For example, the processor 151 determines that the reference voltage is not set when the reference voltage is not stored in the auxiliary storage apparatus 154. For example, the processor 151 determines that the reference voltage is not set when a value of the reference voltage stored in the auxiliary storage apparatus 154 is a value indicating that the reference voltage is not set. When the reference voltage is not set, the processor 151 determines Yes in ACT 11 and proceeds to ACT 12. When the reference voltage is not set, it indicates that the photoreceptor 1151 is not used (factory shipping state).

In ACT 12, the processor 151 performs constant current control so that the current I becomes constant. That is, the processor 151 controls the power supply 1153 so that the current flowing through the charging roller 1152 and the photoreceptor 1151 becomes constant.

In ACT 13, the processor 151 measures the voltage V during the constant current control.

In ACT 14, the processor 151 stores a value of the voltage V measured in ACT 13 as a reference voltage in the auxiliary storage apparatus 154. When the auxiliary storage apparatus 154 already stores the reference voltage, the processor 151 overwrites and stores the reference voltage.

The processor 151 proceeds to ACT 15 after the processing of ACT 14. When the reference voltage is not set, the processor 151 determines No in ACT 11 and proceeds to ACT 15.

In ACT 15, the processor 151 determines whether to perform printing. For example, the processor 151 determines to perform printing in response to receiving information that instructs the processor 151 to perform printing from a personal computer (PC), a server or a smartphone via a network. Alternatively, the processor 151 determines to perform printing in response to a fact that an operation for instructing the processor 151 to perform printing is performed in the operation panel 103. When not determining to perform printing, the processor 151 determines No in ACT 15 and proceeds to ACT 16.

In ACT 16, the processor 151 determines whether to perform processing of replacing the photoreceptor 1151. For example, the processor 151 determines to perform the processing of replacing the photoreceptor 1151 in response to a fact that an operation for starting the replacement of the photoreceptor 1151 is performed in the operation panel 103. When not determining to perform the processing of replacing the photoreceptor 1151, the processor 151 determines No in ACT 16 and returns to ACT 15. Thus, the processor 151 is in a standby state in which ACT 15 and ACT 16 are repeated until it is determined that printing is performed or that the processing of replacing the photoreceptor 1151 is performed.

When determining to perform printing in the standby state of ACT 15 and ACT 16, the processor 151 determines Yes in ACT 15 and proceeds to ACT 17.

In ACT 17, the processor 151 determines a voltage V applied to the charging roller 1152. The voltage V is a voltage in which the surface potential of the photoreceptor layer and the surface potential of the photoreceptor become the same when the reference voltage is applied to the charging roller 1152 using the unused photoreceptor 1151. The processor 151 defines a voltage obtained by adding correction according to a usage amount to the reference voltage stored in ACT 14 as the voltage V. For example, the usage amount is a travel distance value. The travel distance value is a value indicating a travel distance of the photoreceptor 1151. The travel distance of the photoreceptor 1151 is a distance that a point on an outer periphery of the photoreceptor 1151 is moved by the rotation of the photoreceptor 1151. For example, the travel distance when the photoreceptor 1151 rotates once is equal to the circumference of the photoreceptor 1151. However, the processor 151 may use a value proportional to the travel distance of the photoreceptor 1151 as the travel distance value. For example, the processor 151 may use the number of rotations of the photoreceptor 1151 or the number of rotations of the motor for rotating the photoreceptor 1151 as the travel distance value. Alternatively, the processor 151 uses a drive time of the photoreceptor 1151 or a drive time of the motor for rotating the photoreceptor 1151 as the travel distance value. Alternatively, the processor 151 uses an amount of rotation of the photoreceptor 1151 or an amount of rotation of the motor for rotating the photoreceptor 1151 as the travel distance value. Alternatively, the processor 151 uses a printing amount or the number of printing as the travel distance value. The processor 151 can determine a correction amount according to the travel distance value by using known open loop control. The usage amount may be a value based upon a drive time of the image forming apparatus itself or life information of the photoreceptor. Hereinafter, a case where the travel distance value is applied as the usage amount will be described.

In ACT 18, the processor 151 starts measurement of the travel distance value of the photoreceptor 1151.

In ACT 19, the processor 151 starts the rotation of a roller of each unit necessary for printing. The processor 151 also starts the rotation of the photoreceptor 1151 here.

In ACT 20, the processor 151 controls the power supply 1153 so that the voltage V applied to the charging roller 1152 becomes the voltage determined in ACT 17.

In ACT 21, the processor 151 performs printing based upon a printing job.

In ACT 22, the processor 151 stops the rotation of a roller of each unit. The processor 151 also stops the rotation of the photoreceptor 1151 here.

In ACT 23, the processor 151 ends the measurement started in ACT 18.

In ACT 24, the processor 151 adds the travel distance value measured between ACT 18 and ACT 23 to the travel distance value stored in the auxiliary storage apparatus 154. An initial value of the travel distance value stored in the auxiliary storage apparatus 154 is 0. The processor 151 returns to ACT 15 after the processing of ACT 24.

When determining to perform the processing of replacing the photoreceptor 115 in the standby state of ACT 15 and ACT 16, the processor 151 determines Yes in ACT 16 and proceeds to ACT 25.

In ACT 25, the processor 151 perform the processing of replacing the photoreceptor 1151. The processing is, for example, processing of guiding a method for replacing the photoreceptor 1151 by a content displayed on the touch panel 1031 and a sound outputted from the speaker 1033.

In ACT 26, the processor 151 determines whether the processing of replacing the photoreceptor 1151 is completed. For example, the processor 151 detects that the photoreceptor 1151 is replaced by a sensor. When not detecting that the replacement of the photoreceptor 1151 is completed, the processor 151 determines No in ACT 26 and repeats the processing of ACT 26. On the other hand, when detecting that the replacement of the photoreceptor 1151 is completed, the processor 151 determines Yes in ACT 26 and proceeds to ACT 27. The photoreceptor 1151 after the replacement thereof is usually not used.

In ACT 27, the processor 151 resets the travel distance value stored in the auxiliary storage apparatus 154. That is, the processor 151 sets the travel distance value to 0. The processor 151 proceeds to ACT 12 after the processing of ACT 27.

The image forming apparatus 100 of the embodiment measures the reference voltage by performing the constant current control in a state where the photoreceptor 1151 is not used. The image forming apparatus 100 applies a voltage, to which correction according to the travel distance value of the photoreceptor 1151 is added, to the charging roller 1152. Accordingly, the image forming apparatus 100 of the embodiment can maintain the surface potential of the photoreceptor at an appropriate value even though a film pressure of the photoreceptor 1151 is reduced. Therefore, the image forming apparatus 100 of the embodiment is not required to input information indicating the altitude of the image forming apparatus 100. The image forming apparatus 100 of the embodiment may perform the constant current control once in the state where the photoreceptor 1151 is not used, and is not required to perform the constant current control for each printing job. Therefore, the image forming apparatus 100 of the embodiment can prevent occurrence of a defect such as image fogging.

The image forming apparatus 100 of the embodiment determines the reference voltage when the replacement of the photoreceptor 1151 is detected, and stores the determined reference voltage in the auxiliary storage apparatus 154. Therefore, when the photoreceptor 1151 is replaced, the image forming apparatus 100 of the embodiment can determine the reference voltage corresponding to the new photoreceptor 1151 without forgetting.

The image forming apparatus 100 of the embodiment determines the reference voltage when the reference voltage is not set, and stores the determined reference voltage in the auxiliary storage apparatus 154. Therefore, the image forming apparatus 100 of the embodiment can prevent the unused photoreceptor 1151 from being used in a state where the reference voltage is not set.

The image forming apparatus 100 of the embodiment may use the drive time as the travel distance value. Here, since a special sensor is not required to measure the drive time, manufacturing cost can be reduced.

The image forming apparatus 100 of the embodiment may use the rotation amount of the photoreceptor 1151 as the travel distance value. Here, the image forming apparatus 100 can measure the travel distance more accurately than using the drive time.

The embodiment can be modified as follows.

The processor 151 may determine the voltage V by adding correction using the temperature measured by the thermometer 156 in ACT 17. For example, the processor 151 performs correction so that the absolute value of the voltage V becomes larger as the temperature is higher. Accordingly, the image forming apparatus 100 of the embodiment can prevent a change in the surface potential of the photoreceptor caused by the influence of temperature. The processor 151 can determine a correction amount according to the temperature by using the known open loop control.

The processor 151 may determine the voltage V by adding correction using the humidity measured by the hygrometer 157 in ACT 17. For example, the processor 151 performs correction so that the absolute value of the voltage V becomes larger as the humidity is higher. Accordingly, the image forming apparatus 100 of the embodiment can prevent a change in the surface potential of the photoreceptor caused by the influence of humidity. The processor 151 can determine a correction amount according to the humidity by using the known open loop control.

The processor 151 may determine the voltage V by adding correction for development contrast in ACT 17. For example, when the development contrast is desired to be thickened, the processor 151 performs correction so that the absolute value of the voltage V becomes large. Accordingly, the image forming apparatus 100 of the embodiment can change the development contrast. The processor 151 can determine a correction amount according to the development contrast by using known closed-loop or open-loop control.

The processor 151 may redetermine the voltage V by performing the processing of ACT 17 again during the printing in ACT 21. Next, the processor 151 changes the voltage V by performing the processing of ACT 20 again. For example, the processor 151 changes the voltage V in this manner when the printing amount in ACT 20 is equal to or greater than a predetermined amount. Accordingly, the image forming apparatus 100 of the embodiment can prevent the change in the surface potential of the photoreceptor even when the printing amount is large and the film thickness is reduced during printing.

The processor 101 may realize a part or all of the processing to be realized by the program in the embodiment by a hardware configuration of the circuit.

Each apparatus in the embodiment is transferred to, for example, an administrator of each apparatus in a state where the program for executing each processing is stored. Alternatively, each apparatus is transferred to the administrator in a state where the program is not stored. The program is separately transferred to the administrator, and is stored in each apparatus based upon an operation by the administrator or a serviceman. The transfer of the program here can be realized, for example, by using a removable storage medium such as a disk medium or a semiconductor memory, or by downloading via the Internet or a LAN.

While certain embodiments have been described, these embodiments have been presented by way of example only, and are not intended to limit the scope of the invention. Indeed, the novel apparatus and methods described herein may be embodied in a variety of other forms; furthermore, various omissions, substitutions and changes in the form of the apparatus and methods described herein may be made without departing from the spirit of the inventions. The accompanying claims and their equivalents are intended to cover such forms or modifications as would fall within the scope and spirit of the inventions.

What is claimed is:

1. An image forming apparatus, comprising:

a photoreceptor on which an image is formed;

a charging member in contact with or close to a surface of the photoreceptor;

an application component configured to apply a voltage to the charging member;

an auxiliary storage apparatus configured to store a reference voltage applied to the charging member; and a controller configured to:

determine whether or not the reference voltage is stored in the auxiliary storage apparatus when the image forming apparatus is started, determine that the photoreceptor is in an unused state when the reference voltage is not stored in the auxiliary storage apparatus, control a current flowing through the charging member and the photoreceptor at a constant current when the photoreceptor is in the unused state, to measure a voltage when the constant current flows and store the measured voltage as the reference voltage, and to read the reference voltage from the auxiliary storage apparatus when printing, and control the application component to apply a voltage obtained by adding a correction to the reference voltage according to a value indicating a usage amount of the photoreceptor.

2. The image forming apparatus according to claim 1, wherein the controller further adds correction to the reference voltage according to a temperature.

3. The image forming apparatus according to claim 1, wherein the controller further adds correction to the reference voltage according to a humidity.

4. The image forming apparatus according to claim 1, wherein the controller further adds correction to the reference voltage according to a development contrast.

5. The image forming apparatus according to claim 1, wherein the controller measures the voltage and stores the measured voltage as the reference voltage when detecting replacement of the photoreceptor.

6. The image forming apparatus according to claim 1, wherein the controller measures the voltage and stores the measured voltage as the reference voltage when the reference voltage is not set.

7. The image forming apparatus according to claim 1, wherein a value indicating the usage amount is a travel distance value of the photoreceptor.

8. The image forming apparatus according to claim 1, wherein the controller changes the voltage to which the correction according to the value indicating the usage amount of the photoreceptor is added, when a printing amount is equal to or greater than a predetermined amount.

9. A charging method, comprising:

determining whether or not a reference voltage is stored in an auxiliary storage apparatus when an image forming apparatus is started;

determining that a photoreceptor is in an unused state when the reference voltage is not stored in the auxiliary storage apparatus;

controlling a current flowing from a charging member in contact with or close to a surface of the photoreceptor to the photoreceptor at a constant current when the photoreceptor on which an image is formed is in the unused state;

defining a voltage when the constant current flows as the reference voltage;

reading the reference voltage from the auxiliary storage apparatus when printing; and applying a voltage obtained by adding a correction to the reference voltage according to a value indicating a usage amount of the photoreceptor.

10. The charging method according to claim 9, further comprising:

measuring at least one of temperature, humidity, and development contrast; and adding correction to the reference voltage according to at least one of the temperature, humidity, and development contrast.

11. The charging method according to claim 9, further comprising:

measuring the voltage and storing the measured voltage as the reference voltage when detecting replacement of the photoreceptor.

12. The charging method according to claim 9, further comprising:

measuring the voltage and storing the measured voltage as the reference voltage when the reference voltage is not set.

13. The charging method according to claim 9, wherein a value indicating the usage amount is a travel distance value of the photoreceptor.

14. The charging method according to claim 9, further comprising:

changing the voltage to which the correction according to the value indicating the usage amount of the photoreceptor is added, when a printing amount is equal to or greater than a predetermined amount.

15. A controller to reduce image fogging by an image forming apparatus, comprising:

a processor and a memory, the memory storing components that when executed by the processor perform the operations of:

determining whether or not a reference voltage is stored in an auxiliary storage apparatus when the image forming apparatus is started, determining that a photoreceptor is in an unused state when the reference voltage is not stored in the auxiliary storage apparatus;

controlling a current flowing from a charging member in contact with or close to a surface of the photoreceptor to the photoreceptor at a constant current when the photoreceptor on which an image is formed is in the unused state;

defining a voltage when the constant current flows as the reference voltage;

reading the reference voltage from the auxiliary storage apparatus when printing; and applying a voltage obtained by adding a correction to the reference voltage according to a value indicating a usage amount of the photoreceptor.

16. The controller according to claim 15, the operations further comprise:

measuring at least one of temperature, humidity, and development contrast; and adding correction to the reference voltage according to at least one of the temperature, humidity, and development contrast.

17. The controller according to claim 15, the operations further comprise:

measuring the voltage and storing the measured voltage as the reference voltage when detecting replacement of the photoreceptor.

18. The controller according to claim 15, the operations further comprise:

measuring the voltage and storing the measured voltage as the reference voltage when the reference voltage is not set.

19. The controller according to claim 15, wherein a value indicating the usage amount is a travel distance value of the photoreceptor.

20. The controller according to claim 15, the operations further comprise:

changing the voltage to which the correction according to the value indicating the usage amount of the photoreceptor is added, when a printing amount is equal to or greater than a predetermined amount.

* * * * *